United States Patent [19]

Reynolds, Jr.

[11] Patent Number: 4,510,363

[45] Date of Patent: Apr. 9, 1985

[54] KILN FOR HOT-PRESSING COMPACTS IN A CONTINUOUS MANNER

[75] Inventor: Carl D. Reynolds, Jr., Clinton, Tenn.

[73] Assignee: The United States of America as represented by the United States Department of Energy, Washington, D.C.

[21] Appl. No.: 521,496

[22] Filed: Aug. 8, 1983

[51] Int. Cl.[3] ..... H05B 6/02

[52] U.S. Cl. ..... 219/10.71; 219/10.49 R; 219/388; 100/92; 425/407; 432/163; 432/143

[58] Field of Search ..... 219/10.69, 10.71, 10.73, 219/10.75, 10.49 R, 10.57, 388, 10.55 A; 100/93 P, 92; 432/128, 163, 143, 148, 205, 79, 81, 77; 425/40, 41, 174.8 R, 174.8 E, 363, 407, 509, 548; 264/25-27, 319, 320, 327

[56] References Cited

U.S. PATENT DOCUMENTS 2,965,369 12/1960 Acker et al. ..... 219/10.71 X
3,078,506 2/1963 Caughey ..... 100/93 P
3,352,229 11/1967 Morse ..... 100/93 P X
3,419,698 12/1968 Palmero et al. ..... 219/10.69
3,881,403 5/1975 Ingram et al. ..... 219/10.55 A X
3,926,415 12/1975 Konas et al. ..... 219/10.73 X
4,444,557 4/1984 Kimura et al. ..... 432/143 X

*Primary Examiner*—Philip H. Leung
*Attorney, Agent, or Firm*—Earl L. Larcher; Stephen D. Hamel; Judson R. Hightower

[57] ABSTRACT

The present invention is directed to a hot pressing furnace or kiln which is capable of preheating, hot pressing, and cooling a plurality of articles in a sequential and continuous manner. The hot pressing furnace of the present invention comprises an elongated, horizontally disposed furnace capable of holding a plurality of displaceable pusher plates each supporting a die body loaded with refractory or ceramic material to be hot pressed. Each of these plates and the die body supported thereby is sequentially pushed through the preheating zone, a temperature stabilizing and a hot pressing zone, and a cooling zone so as to provide a continuous hot-pressing operation of a plurality of articles.

7 Claims, 2 Drawing Figures

KILN FOR HOT-PRESSING COMPACTS IN A CONTINUOUS MANNER

This invention was made as a result of work under Contract W-7405-ENG-26 between Union Carbide Corporation Nuclear Division and the U.S. Department of Energy.

BACKGROUND OF THE INVENTION

The present invention relates generally to a hot-pressing furnace or kiln and more particularly to such a furnace wherein a plurality of die sets containing material to be hot pressed are heated, hot pressed and cooled in a sequential and continuous manner.

Hot pressing ceramic and refractory materials has proven to be a viable process for forming refractory and ceramic articles of desired configurations. In conventional hot-pressing operations, a die body loaded with ceramic or refractory material is placed in a hot-pressing furnace, heated to the desired pressing temperature, pressed, and then removed for cooling. This operation requires a considerable period of time for the pressing of one article. Often times the process is speeded up by preheating the loaded die bodies in a separate furnace and then moving the die body to a hot-pressing furnace for the pressing operation. In either event, a considerable amount of time is required for the pressing of articles which would be considerably expensive and time consuming when a large number of articles are to be hot pressed.

SUMMARY OF THE INVENTION

It is the primary aim or objective of the present invention to provide a kiln for hot pressing ceramic and refractory articles that is capable of simultaneously treating a plurality of die sets loaded with the compactable material in a continuous and repetitive manner. This objective is achieved by a hot-pressing kiln for heating, pressing, and cooling compacts in a continuous manner and comprises an elongated, horizontally disposed furnace housing which contains a plurality of serially arranged chambers. The first chamber in registry with one end of the housing provides a preheating zone for heating the compactable material to the desired hot-pressing temperature. A second chamber is in registry with the first chamber and incorporates press means and further heating means for providing temperature equilibrium of the preheated die sets prior to the hot pressing of the material in the press means. A third chamber is, in turn, in registry with the second chamber and provides a cooling zone for cooling the hot-pressed compacts. In the kiln of the present invention, die bodies are loaded one at a time into the first chamber and sequentially displaced through the chambers to provide a continuous heating, pressing, and cooling operation of the material in the die bodies as they are displaced through the kiln. By employing the present invention, a plurality of loaded die bodies are sequentially hot pressed for effectively decreasing the time heretofore required for hot pressing articles and for substantially reducing the cost of hot pressing refractory and ceramic material.

Other and further objects of the invention will be obvious upon an understanding of the illustrative embodiment about to be described or will be indicated in the appended claims, and various advantages not referred to herein will occur to one skilled in the art upon employment of the invention in practice.

Figure 1:
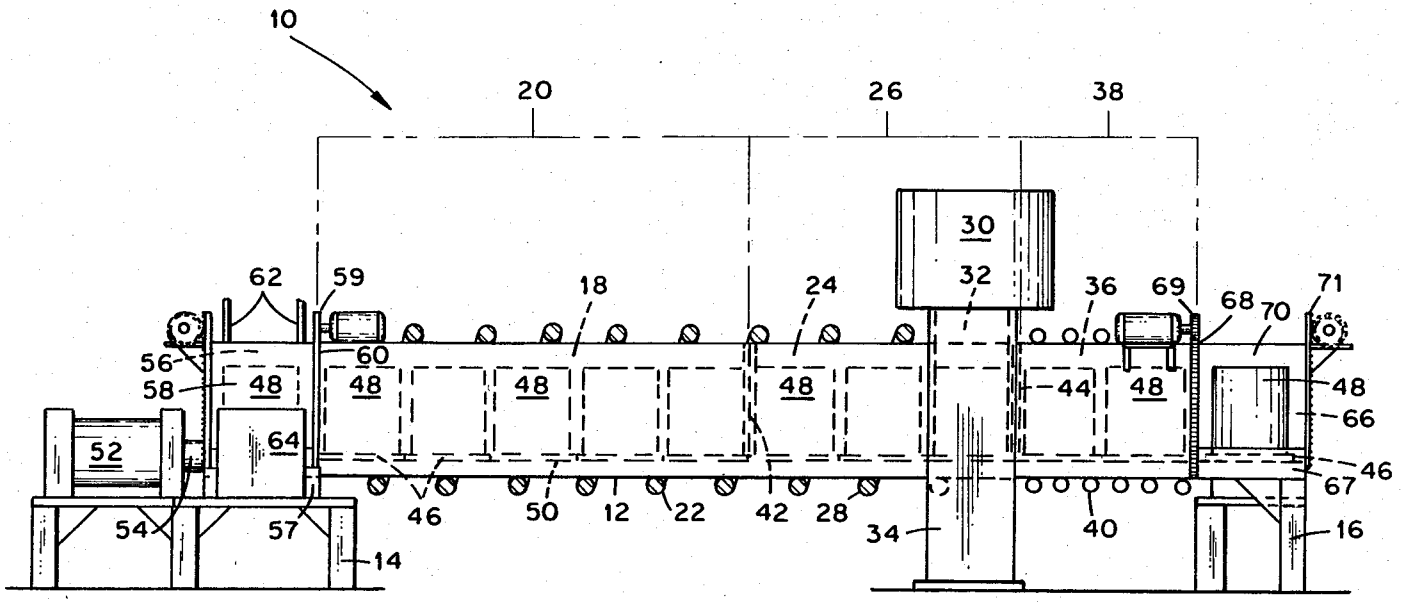
FIG. 1 is an elevational view of the kiln of the present invention showing a plurality of loaded die bodies within the kiln for sequential hot pressing in a continuous manner.
Figure 2:
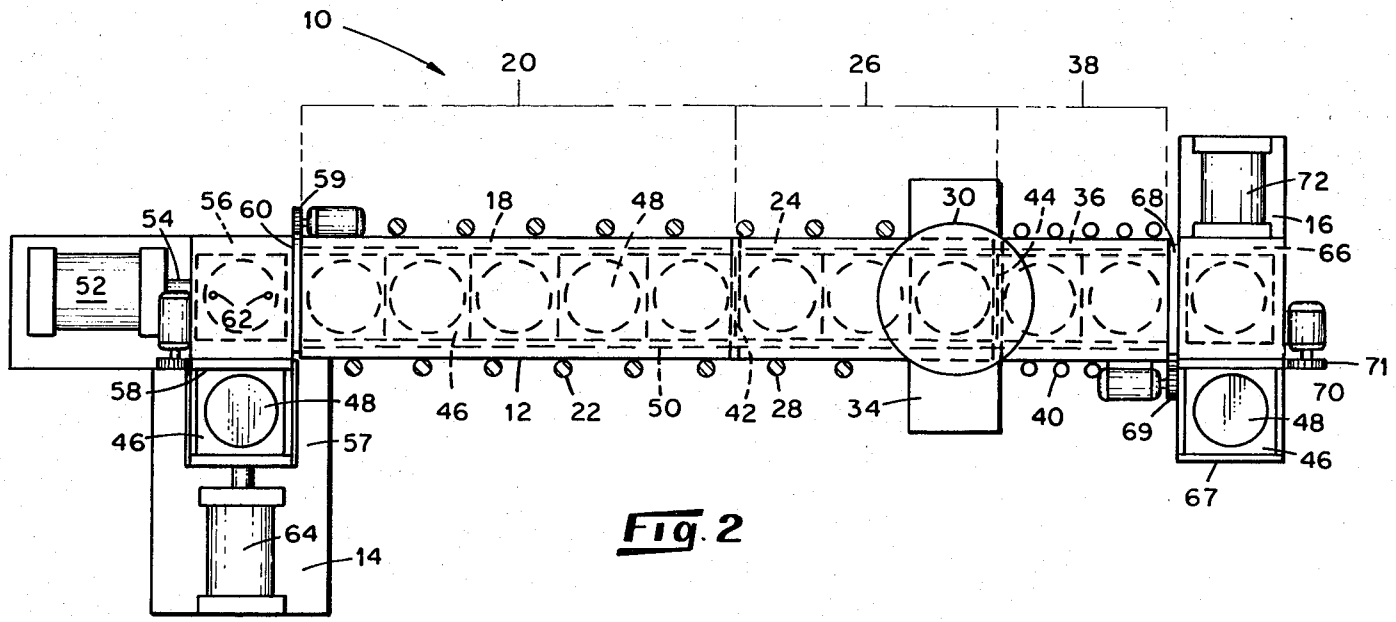
FIG. 2 is a top plan view of the FIG. 1 embodiment showing further details of the hot-pressing kiln of the present invention.

A preferred embodiment of the invention has been chosen for the purpose of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated.

DETAILED DESCRIPTION OF THE INVENTION

As briefly mentioned above, the present invention is directed to a hot pressing kiln for heating, hot pressing, and cooling compacts in a continuous manner. The kiln comprises an elongated, horizontally disposed furnace housing. A plurality of chambers are serially arranged in the housing with a first chamber in registry with one end of the housing comprising a preheating zone. Heating means are provided for heating this preheating zone. A second chamber is placed in registry with the first chamber and comprises a further heating and hot pressing zone. The second chamber contains heating means as well as a press means which is operatively associated with the chamber. A third chamber is in registry with the second chamber adjacent the other end of the housing and provides a cooling zone. Means are utilized for displacing at least one die means containing hot-pressable material sequentially through the chambers while sequentially heating the contents of the die means in the first chamber to a temperature adequate for the hot pressing operation, stabilizing or equilibrilizing the temperature of the contents in the second chamber prior to the hot pressing of the contents in the die means, and then cooling the hot pressed contents in the third chamber.

Described in greater detail and with reference to the accompanying drawings, the hot pressing furnace or kiln assembly of the present invention is generally shown at 10. This kiln comprises an elongated, horizontally disposed housing 12 supported by suitable stands 14 and 16. The housing 12 is divided into three chambers. The first chamber 18 extends from one end of the housing 12 towards the center of the housing and defines a preheating zone 20. The heating of the preheating zone may be provided by any suitable heating mechanism such as radio frequency coils or resistance heating coils such as shown at 22. The preheating zone provides for the heating of the contents of die bodies therein to a temperature sufficient for hot pressing the material contained in the die bodies as will be described below. The second chamber 24 is disposed intermediate the opposite ends of the housing 12 and defines a temperature stabilization or equilibration and hot pressing zone 26. The second chamber is in registry with the first chamber and is provided with a suitable heating mechanism such as coils 28 which may be similar to those used in the first chamber 18 for providing temperature equilibration to the material to be hot pressed. After temperature equilibration of the die body contents the hot pressing is achieved in the second chamber 24 by a hydraulic press 30.

The hydraulic press 30 is supported external of the housing 12 at a location in the second chamber remote to the first chamber so as to assure that the loaded die bodies within the second chamber achieve temperature equilibration prior to the hot pressing operation. The press 30 is provided with a ram 32 which penetrates into the housing 12 through a suitable seal mechanism (not shown). A platen 34 is utilized for supporting the press 30 and providing a rigid base against which the ram 32 may operate.

A third chamber 36 is in registry with the second chamber 24 and the end of the housing 12 to define a cooling zone 38 which is utilized for cooling the hot pressed components when displaced from the press 30. If desired, cooling conduits 40 conveying a suitable cooling liquid may be disposed about the cooling zone 38 for cooling the hot pressed compacts prior to their removal from the kiln.

A baffle 42 is disposed between the first and second chambers 18 and 24 for separating the preheating zone 20 from the temperature equilibration zone 26 so as to assure uniform heat levels within the second chamber 24. This baffle 42 may be formed of a suitable curtain of a suitable flexible refractory curtain material such as a fiberglass blanket which is displaceable by the die bodies as they are moved therethrough and returns to its original position after die displacement to form an effective thermal insulating barrier. Alternatively, the barriers can be provided by a sliding door or partition which may be moved or opened as the die bodies are displaced from the first chamber 18 into the second chamber 24. Another baffle 44 is disposed between the second and third chambers 24 and 36 to provide separation therebetween. This baffle 44 may be similarly constructed to baffle 42 and is utilized to retain the heat within the hot-pressing zone 26 as well as to prevent the heat from the second chamber 24 from entering and disrupting the cooling of the pressed compacts in the cooling zone 38.

A plurality of discrete pusher plates or slabs 46 each of which is of a size adequate to support a die body 48 containing the material to be hot pressed are placed with or without a die body thereon into the first chamber 18 one at a time and then sequentially displaced through the preheating zone 20, the temperature stabilization and hot-pressing zone 26 and the cooling zone 38 on suitable guiderails 50. The die bodies 48 may be formed of any suitable material such as graphite or the like for containing the ceramic or refractory material to be hot pressed.

In order to displace the pusher plates or slabs 46 through the kiln 10 a hydraulic ram such as generally shown at 52 may be utilized. A piston 54 of this ram is extended to contact the base of the pusher plate 46 near the entrance to the housing 12 so as to move the plate 46 into the first chamber 18 a distance equal to the length of the plate 46. As this plate 46 is displaced by the piston 54 into the first chamber 18 it bears against the plate 46 in front of it to push it one more step or position into the chamber 18. As the furnace housing 12 is loaded with plates 46, a sufficient number of die bodies 48 are contained in the housing 12 so as to provide the continuous operation. However, if only several die bodies 48 are to be loaded with material to be pressed some of the pusher plates 46 may be used without the die bodies 48 so as to provide the continuous pressing of material in the number of dies selected.

To load the pusher plates 46 into the furnace housing 12 while maintaining the desirable atmosphere within the furnace confines, a loading compartment 56 is disposed at one end of the housing 12 adjacent the entrance into the first chamber 18. A loading stand 57 is shown disposed next to the loading compartment 56 for supporting a single pusher plate 46 with or without a die body 48 supported thereon. A door 58 to the compartment is utilized for an entrance of the pusher plate 46 and die body into the compartment 56. This door 58 may be suitably actuated by any suitable mechanism such as a rack and pinion assembly shown at 59. When the door 58 is opened and the loaded pusher plate 46 inserted into compartment 56, the door 58 is closed and a second door 60 disposed between the compartment 56 and the first chamber 18 is opened to permit the piston 54 of the hydraulic ram 52 to displace the pusher plate 46 into the first chamber 18. Prior to the opening of the door 60 the compartment is preferably purged with an inert gas such as nitrogen, argon or the like to provide a suitable atmosphere within the compartment and subsequently into the housing 12. Purge lines 62 are shown for admitting and exhausting the gases from the compartment 56. A hydraulic ram 64 may be utilized for moving loaded pusher plates into the compartment 56 if the size and weight of the loaded pusher plates are such as to discourage manual handling.

A similar compartment 66 is disposed at the opposite end of the housing 12 for providing an unloading compartment. A stand 67 is shown near the unloading compartment 66 for receiving pusher plates 46 with hot-pressed die bodies discharged through the compartment 66. A door 68 between the compartment 66 and the cooling chamber 36 is opened when the die body 48 is to be pushed from the cooling zone 38 into the unloading compartment 66 by the piston 54 of the hydraulic ram 52. Normally, the door 68 will remain closed until the housing 12 is fully loaded with the pusher plates 46. A rack and pinion assembly 69 may be utilized for opening the door 68. The unloading compartment 66 is also provided with an exit door 70 on a side thereof an in alignment with the ram or stand 67. This door may be operated by a rack and pinion assembly as shown at 71.

With a plate 46 supporting a die body 48 having a hot pressed article therein in the unloading compartment 66 and the door 68 to chamber 36 closed, the exit door 70 is opened and a hydraulic ram 72 is utilized to push the pusher plate 46 from the compartment 66 onto the stand 67 for removal therefrom.

The arrangement above described provides for a continuous operation wherein die bodies 48 containing material to be pressed may be sequentially heated, hot pressed, and cooled in a continuous manner.

In a typical operation of the continuous kiln of the present invention, a pusher plate 46 is loaded with a graphite die body 48 containing ceramic or refractory material to be hot pressed and then positioned on the loading stand 57 adjacent compartment 56. The door 58 to the compartment is raised and the loaded die assembly is pushed into the compartment by the hydraulic ram 64. With both doors 58 and 60 then closed the compartment 56 is purged with an inert gas to provide an atmosphere containing less than about 1 vol. % oxygen. The door 60 between the compartment 56 and the first chamber 18 is opened and the piston 54 of the hydraulic ram 52 is actuated to move the loaded pusher plate 46 into the first chamber 18. This operation is repeated for loading the housing with plates 46 containing loaded die bodies 48 by advancing the loaded plates 46 sequentially through the furnace. The doors or barriers between the chambers may be operated in a timed fashion to correspond to the operation of the piston 54 to assure that the loaded die plates 46 are displaced from chamber to chamber without encountering heat loss between the chambers or causing excess heat to be present in the cooling zone 38. When a loaded pusher plate 46 is sufficiently preheated in chamber 18 it is pushed by the piston 54 into the second chamber 24 where temperature equilibrium is achieved for the pressing operation which occurs by actuating the hydraulic press 30. With the ram 32 of press 30 completing the hot pressing operation a new loaded pusher plate 46 is displaced from compartment 18 into the housing and the pusher plate 46 with the hot-pressed compact thereon is moved into the cooling zone 38. When the cooled die body 48 or the pusher plate 46 reaches the end of the housing 12 adjacent the exit or unloading compartment 66, the door 68 is opened and the piston 54 displaces a finished hot pressed article on the pusher plate 46 into the exit compartment 66 through the open door 68. The exit door 68 is closed and the door 70 into this compartment 66 is then opened and the die body with the finished hot pressed article is displaced from the unloading compartment 66 onto the stand 67 for subsequent removal. In this manner, the hot pressing operation is continuous so as to significantly facilitate the pressing operation in a manner not heretofore achievable.

What is claimed is:

1. A hot pressing kiln for heating, hot pressing, and cooling compacts in a continuous manner, comprising:

an elongated, horizontally disposed housing;

a plurality of chambers serially arranged in said housing;

a first chamber of said plurality of chambers disposed in registry with one end of said housing for defining a preheating zone;

heating means for heating said preheating zone;

a second chamber of said plurality of chambers disposed in registry with the first chamber for defining a heating stabilization and hot-pressing zone;

at least one die means for containing hot-pressable material;

further heating means and press means operatively associated with said second chamber with said press means being disposed in said second chamber and comprising a hydraulic press with a ram penetrating said housing and contactable with the heated contents of said die means for effecting the hot pressing thereof;

a third chamber of said plurality of chambers disposed in registry with the second chamber and the other end of said housing opposite said one end for defining a cooling zone; and means for displacing said at least one die means sequentially through said chambers while sequentially preheating the contents of said die means in the first chamber, providing temperature equilibration and hot pressing of the contents of said die means in the second chamber, and cooling the hot pressed contents of said die means in the third chamber.

2. A hot pressing kiln as claimed in claim 1 wherein a plurality of discrete plate means are serially disposable within said housing with each of said plate means supporting one of said die means, said means for displacing said at least one die means comprises a ram engageable with one of said plate means at a location adjacent said one end for displacing the plate means engaged therewith and any plate means between the latter and said other end a distance through said housing corresponding the length of one of said plate means.

3. A hot pressing kiln as claimed in claim 1 including a compartment at said one end of said housing of a size sufficient to hold one of said at least one die means, said compartment having first and second door means said second door means isolating said compartment from said first chamber, means for opening and closing said first door means for sequentially receiving said at least one die means in said compartment and for confining said at least one die means in said compartment, purge means for purging the compartment to provide a desired atmosphere therein, means for opening and closing said second door means while said die means is in said compartment, and wherein said means for displacing said die means displaces the latter from said compartment into said first chamber while said second door means is open.

4. A hot pressing kiln as claimed in claim 3 including a second compartment at said other end of said housing of a size sufficient to hold one of said die means, said second compartment having third and fourth door means, means for sequentially opening and closing said third and fourth door means for receiving in said second compartment one of said die means from said third chamber through said third door means while the fourth door means is closed and for removing said die means from said second compartment through said fourth door means while said third door means is closed and isolating said second compartment from said third chamber.

5. A hot pressing kiln as claimed in claim 4 wherein a plurality of discrete plate means are serially disposable within said housing with each of said plate means supporting one of said die means, said means for displacing said at least one die means comprises a ram engageable with one of said plate means at a location adjacent said one end for displacing the plate means engaged therewith and any plate means between the latter and said other end a distance through said housing corresponding the length of one of said plate means.

6. A hot pressing kiln as claimed in claim 5 wherein further displacing means are disposed at said one end of the housing for moving one of said plate means into said first-mentioned compartment when said first door means are open.

7. A hot pressing kiln as claimed in claim 6 wherein baffle means are disposed between the first and second chamber and between the second and third chamber for isolating the chambers from one another, said baffle means each comprises a flexible refractory curtain for providing unimpeeded passage of said die means therethrough during displacement of said die means, with said baffle means returning to its original position after the displacement of said die means therethrough to form an effective thermal insulating barrier.

* * * * *